United States Patent [19]

Tippetts et al.

[11] 3,993,101

[45] Nov. 23, 1976

[54] TRISTABLE FLUIDIC DEVICE

[75] Inventors: Thomas B. Tippetts; Donald W. Chapin, both of Scottsdale, Ariz.

[73] Assignee: The Garrett Corporation, Los Angeles, Calif.

[22] Filed: Aug. 25, 1975

[21] Appl. No.: 607,529

[52] U.S. Cl. ..... 137/831; 137/83

[51] Int. Cl.[2] ..... F15C 1/10; F15C 3/00

[58] Field of Search ..... 137/822, 823, 829, 830, 137/831, 832, 833, 597, 83; 73/37.6, 37.7, 37.8

[56] References Cited

UNITED STATES PATENTS

| | | | |
|---|---|---|---|
| 3,509,775 | 5/1970 | Evans | 137/829 X |
| 3,516,439 | 6/1970 | Hicks et al. | 137/829 X |
| 3,638,671 | 2/1972 | Harvey et al. | 137/831 |
| 3,771,567 | 11/1973 | Linden | 137/831 X |
| 3,866,620 | 2/1975 | Morton | 137/83 |
| 3,906,979 | 9/1975 | Chapin | 137/831 X |

*Primary Examiner*—William R. Cline
*Attorney, Agent, or Firm*—James W. McFarland; Albert J. Miller

[57] ABSTRACT

An electrofluidic transducer which utilizes an electromagnetic device that is energizable by electric currents of opposite polarity to shift a fluid beam in opposite directions away from a central position. In its central position the beam deflector is between a pair of fluid nozzles, and shifts to deflect respective fluid beam from the two nozzles upon opposite energization of the electromagnet, so that three different pressure differential signals may be selectively impressed upon a pair of fluid output ports registering with the pair of fluid nozzles.

6 Claims, 3 Drawing Figures

TRISTABLE FLUIDIC DEVICE

BACKGROUND OF THE INVENTION

The invention herein was made in the course of or under a contract with the Department of the Navy.

This invention relates to fluidic devices and electrofluidic transducers, and relates more particularly to an improved tristable fluidic device construction useful as an electrofluidic transducer. The present invention is an improvement upon devices such as illustrated in U.S. Pat. No. 3,638,671 entitled "Electrofluidic Transducer".

SUMMARY OF THE INVENTION

It is a primary object of the present invention to provide a fluidic device having a single moving element which is capable of producing three distinct pressure differential output signals across a pair of fluid output ports.

Another important object of the present invention is to provide an electrofluidic transducer utilizing a tristable device as set forth in the preceding object, which is capable of transforming three different electric input signals into three corresponding, different fluidic pressure differential signals.

A preferred form of the invention contemplates a fluidic device structure which includes a fluid supply port supplying fluid under pressure to a pair of laterally spaced fluid nozzles that are in general alignment and registration with an associated pair of fluid output ports longitudinally spaced from the associated nozzles. An electromagnetic device has a fluid deflector pin connected to the armature thereof and depending in a third direction perpendicular to the lateral and longitudinal directions such that the pin in its normal central position is located laterally between the fluid beams. In this central position both output ports are in registration with the associated input ports and equal pressure is developed in the two output ports. Upon energizing the electromagnet with electric current of one polarity, the pin is shifted in one direction to deflect or interrupt fluid from one of the nozzles into a fluid vent such that the associated output port carries lower pressure than the other, non-interrupted output port. Upon shifting the fluid beam in an opposite direction by energizing the electromagnet with current of an opposite polarity, an opposite fluid pressure differential signal is generated across the two output ports.

These and other objects and advantages of the present invention are specifically set forth in or will become apparent from the following detailed description of a preferred form of the invention when read in conjunction with the accompanying drawings.

DETAILED DESCRIPTION OF THE PREFERRED EMBODIMENTS

Figure 1:
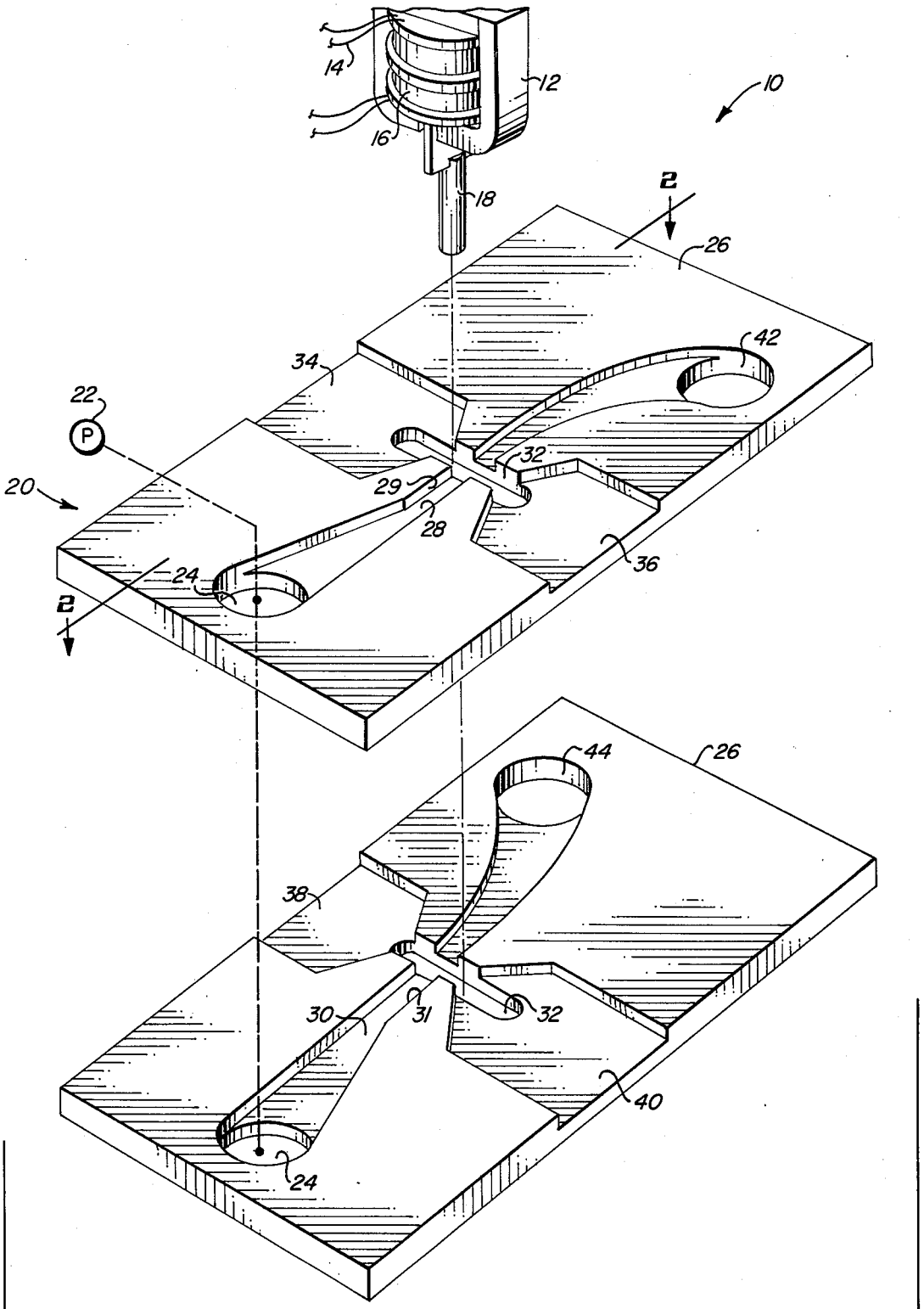
FIG. 1 is an exploded, perspective view of an electrofluidic transducer as contemplated by the present invention.
Figure 2:
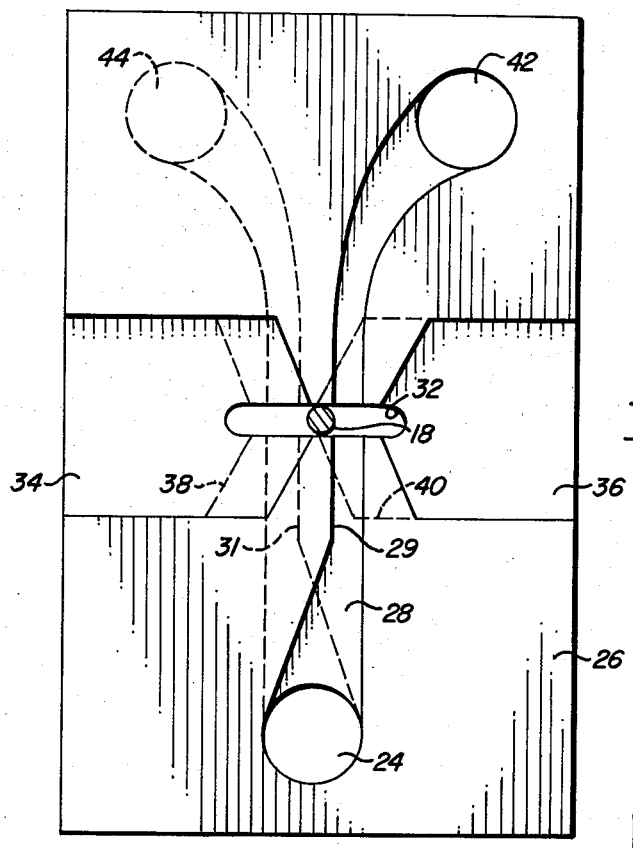
FIG. 2 is a plan, cross-sectional view along lines 2—2 of FIG. 1.

Referring now more particularly to the drawings, there is illustrated in FIGS. 1 and 2 an electrofluidic transducer generally designated by the numeral 10. Transducer 10 includes an electromagnetic device 12 having appropriate electrical connections 14 which may be selectively interconnected through appropriate electrical switch means with a current supply in order to selectively impress currents of opposite polarity upon an armature 16 of the electromagnet. The electromagnet has depending in a first, vertical direction a fluid deflector 18 operably coupled to armature 16. Deflector 18 is preferably of a pin-like configuration, being elongated in the vertical direction and having a circular cross section to present a rounded, outer, fluid contacting surface.

The transducer further includes an associated fluidic device generally denoted by the numeral 20 which includes a source of pressurized fluid 22 operably communicating with a fluid inlet port 24 formed in a body 26. For clarity, the body 26 is shown as a pair of vertically-spaced laminates. The body 26 may be a plurality of laminates that are rigidly intersecured, or may be a single element having the appropriate passages formed therein in the manner illustrated.

Communicating with inlet port 24 are a pair of fluid nozzles 28, 30 which are vertically spaced from one another with their outer, fluid-issuing ends laterally spaced from each other. These outer fluid-issuing ends open into a laterally extending, vertically-through slot 32. Nozzles 28 and 30 are of substantially equal width in the lateral direction, and are laterally spaced from one another a distance substantially equal to or at least as great as the nozzle width. Laterally spaced outwardly from either size of nozzle 28 are fluid vent ports 34 and 36, and similarly with respect to nozzle 30 there is included a corresponding pair of fluid vents 38 and 40.

Nozzles 28 and 30 extend in a longitudinal direction to respectively direct fluid beams at associated, registering outlet ports 42 and 44 which are longitudinally spaced from the respective nozzles 28 and 30. Each of the outlet ports 42 and 44 open into slot 32 and are in general alignment with the associated nozzles 28 and 30.

The electromagnetic device 12 is arranged relative to device 20 such that deflector pin 18 depends vertically downwardly through slot 32. In its normal, central position as illustrated in FIG. 2, pin 18 is located between nozzles 28 and 30. Pin 18 is of a diameter approximately equal to the width of nozzles 28 and 30, and therefore equal to the width of the space laterally separating the two nozzles.

In operation, when the electromagnet is de-energized, the depending deflector pin 18 is located in its central, FIG. 2 position in noncontacting relationship with the fluid beams respectively issuing from nozzles 28 and 30 into the output ports 42 and 44. Accordingly, in this central position output ports 42 and 44 carry equal pressure and one fluidic pressure differential output signal condition is created i.e., zero pressure differential across output ports 42 and 44.

Upon energizing electromagnet 12 with electric current of one polarity, deflector pin 18 is shifted in a lateral direction, for instance to the right in FIG. 2. In this position the rounded outer surface of pin 18 contacts and deflects the fluid beam issuing from nozzle 28 into the low pressure vent areas 34 and 36. As a result, fluid flow from nozzle 28 to the associated, registering output port 42 is interrupted while fluid from the other nozzle 30 continues into output port 44. In this manner, a second fluid pressure differential output condition is established with fluid pressure in output port 44 approximately equal to inlet port 24 pressure, and substantially greater than the fluid pressure in output port 42.

Upon energizing the electromagnet with electric current of opposite polarity to that discussed above, the deflector pin 18 shifts laterally in an opposite direction, in this case in a leftward direction in FIG. 2. The fluid beam issuing from nozzle 30 is thereby deflected from port 44 into the associated fluid vent areas 38 and 40. Accordingly, in this manner the third fluid pressure differential condition is established with fluid pressure in the noninterrupted output port 42 being approximately equal to that in the inlet port and substantially greater than fluid pressure in the interrupted output port 44.

Accordingly, the present invention presents a tristable fluid device capable of establishing three fluidic pressure differential output signal conditions in relation to three different electrical signals imposed upon the electromagnetic device 12. By locating the nozzles 28 and 30 and the associated output ports 42 and 44 in different planes as illustrated in FIG. 1, minimal fluid interaction between the fluid beams issuing from the two nozzles 28 and 30 is avoided in all positions of the fluid beam, since each of the nozzles 28 and 30 have associated fluid vent means 34–40 on each side thereof. Further, the device exhibits substantially greater pressure and power recovery, with pressures in the noninterrupted output ports approximately equal to inlet port pressure.

Placement of the nozzles and registering output ports in different planes also allows greater flexibility in the relative lateral positioning of the nozzles. For instance, the nozzles can overlap one another laterally or may be located with the left-hand wall 29 of nozzle 28 in substantial vertical alignment with the right-hand wall 31 of nozzle 30. A continuous, proportional pressure differential output signal can be developed by this latter arrangement as the single pin deflector 18 moves contiguously across nozzles 28 and 30, and yet the device still has relatively high pressure recovery characteristics.

Figure 3:
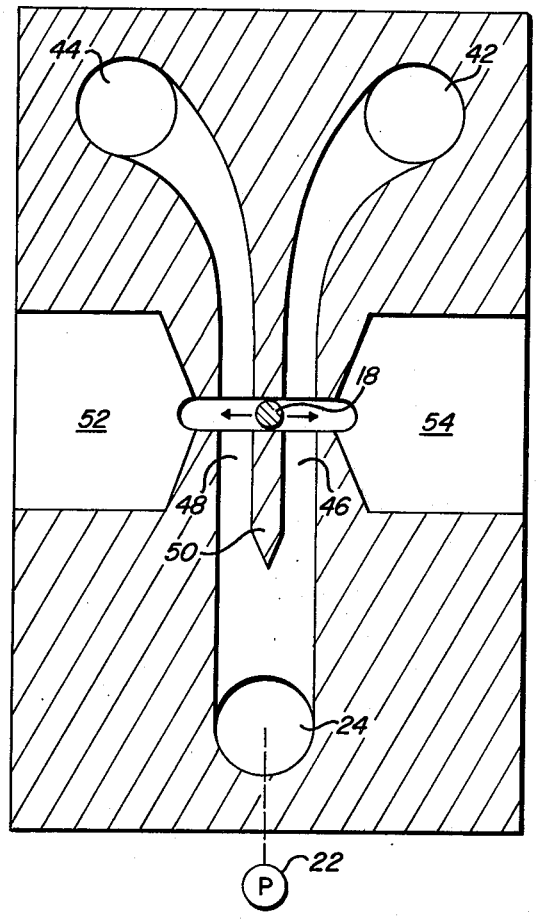
FIG. 3 is a plan, cross-sectional view of a modified form of device as contemplated by the present invention.

FIG. 3 illustrates a modified form of the invention wherein the two fluid beams 46 and 48 are disposed in the same vertical plane in contrast to the vertically misaligned fluid nozzles 28 and 30 of FIGS. 1 and 2. The FIG. 3 arrangement incorporates the vertical extending, round, beam deflector 18 which is again shiftable between its central position illustrated wherein it is disposed behind a central wall 50 separating nozzles 46 and 48 so as to be in non-interfering relationship with both of the fluid beams issuing from the nozzles to the respective output ports 42 and 44. Disposed laterally outwardly from either side of the fluid beams are a pair of fluid vent areas 52 and 54. By the similarity of structure, it is believed that the operation of the FIG. 3 arrangement will be apparent by reference to the above description with respect to the operation of FIG. 1. Again, the FIG. 3 arrangement like the FIG. 1 arrangement is operable to produce three distinct fluid pressure differential signals across output ports 42 and 44 in relation to the three positions of movable beam deflector pin 18.

From the foregoing it will be apparent that the present invention contemplates an improved method of producing a tristable fluid pressure differential output signal having three distinct values of pressure differential across a pair of output ports, which includes the production of a pair of fluid beams from the nozzles 28 and 30 which respectively register with and are dischargeable from the associated communicating output ports 42 and 44. Deflector 18 is selectively positioned in a central position in noncontacting relationship with both fluid beams so that the latter are discharged from both fluid ports 42 and 44 and zero net fluid pressure differential is created across the two output ports. The fluid beam is selectively shifted in one direction by energizing the electromagnet 12 with current of one polarity so as to contact and interrupt the fluid beam issuing from nozzle 28 without interrupting the fluid beam issuing from nozzle 32, to thereby produce another, distinct pressure differential signal across output ports 42 and 44. Similarly, the electromagnet is energized by current of opposite polarity to contact and interrupt the fluid beam from nozzle 30 without contacting or interrupting the beam from nozzle 28 to produce the third, distinct pressure differential signal across output ports 42 and 44. The electromagnet is selectively de-energized to position the beam deflector in its central position.

Various modifications and alterations to the specific embodiments of the present invention described in particular detail above will be apparent to those skilled in the art. Accordingly, the foregoing detailed description should be considered exemplary in nature and not as limiting to the scope and spirit of the invention as set forth in the appended claims.

Having described the invention with sufficient clarity that those skilled in the art may make and use it, we claim:

1. A tristable fluidic device, comprising:

means forming a pair of laterally spaced nozzles and a pair of output ports generally respectively aligned with said pair of nozzles and longitudinally spaced therefrom, each of said pair of nozzles adapted to receive fluid under pressure from a source and direct an associated fluid beam in a longitudinal direction generally toward the associated output port; and deflector means disposed between said pair of nozzles and said pair of output ports for shifting laterally therebetween, said deflector means being selectively positionable in a center position between said pairs of nozzles to allow the fluid beams of both said nozzles to discharge through the associated, aligned output ports, said deflector means being shiftable in opposite directions away from said center position to respectively interrupt flow of one and the other of said fluid beams to the associated output ports, one of said pairs of nozzles and the output port aligned and associated therewith being effectively disposed in a first plane, and the other of said nozzles and the output port associated therewith being effectively disposed in another plane spaced from said one plane in a third direction generally perpendicular to said longitudinal and said lateral direction, to substantially prevent fluid interaction between said one and said other beams in all positions of said deflector means.

2. A device as set forth in claim 1, further including fluid vent means disposed laterally outwardly on each side of each of said pair of fluid nozzles, said deflector means being operable upon shifting laterally in one direction away from said neutral position to deflect said one fluid beam to said fluid vent means, and operable upon shifting in the opposite direction to deflect said other fluid beam to said fluid vent means.

3. A device as set forth in claim 1, wherein said nozzles are of substantially equal width and are laterally spaced a distance at least as great as said width of the nozzles, said deflector means extending in said third direction and having a rounded beam engaging surface of a width substantially equal to the width of said nozzles.

4. A device as set forth in claim 3, further including electromagnetic means for moving said deflector means and including an armature operably connected to said deflector means to move the latter in opposite direction from said center position.

5. An electro-fluidic transducer, comprising:

electromagnetic means having an armature;

deflector means operably coupled to said armature and extending therefrom in a first direction, said electromagnetic means being operable to shift said deflector means in a second direction substantially perpendicular to said first direction and in opposite directions away from a central position upon respectively energizing said electromagnetic means with currents of opposite polarity, said deflector means being disposed in said central position whenever said electromagnetic means is de-energized;

means forming a pair of fluid nozzles extending generally parallel to one another in a third direction substantially perpendicular to said first and second directions, said nozzles being of substantially equal width and being spaced from one another in said section direction a distance approximately equal to said width of the nozzles, said nozzles adapted to receive fluid under pressure from a source and direct fluid beams therefrom in said third direction, said deflector means extending between said nozzles and disposed therebetween in said central position thereof, said deflector means upon shifting oppositely in said second direction away from said central position being operable to respectively deflect said fluid beams issuing from one and the other of said pair of nozzles;

fluid vent means disposed on opposite sides of each of said fluid nozzles for receiving fluid deflected respectively from said one and said other nozzle upon said opposite shifting of the said deflector means; and a pair of output ports respectively disposed in fluid registration with said pair of nozzles, whereby upon positioning said deflector means in a central position said fluid beams of each of said pair of nozzles are discharged through the respective registering output ports, and upon shifting said deflector means oppositely from said central position one and then the other of said fluid beams is allowed to discharge through the associated registering output port while the fluid beam deflected by said deflector means is directed to said associated fluid vent means, said pair of fluid nozzles being relatively arranged such that said fluid beams are spaced from one another in said third direction to substantially prevent fluid interaction between said fluid beams in all positions of said deflector means.

6. A fluidic device, comprising:

means forming first and second laterally spaced nozzles and first and second output ports generally respectively aligned with said first and second nozzles and longitudinally spaced therefrom, each of said first and second nozzles adapted to receive fluid under pressure from a source and direct an associated fluid beam in a longitudinal direction generally toward said first and second output ports respectively, said first nozzle and first output port being effectively disposed in a first plane, said second nozzle and second output port being effectively disposed in a second plane spaced from said first plane in a third direction generally perpendicular to said longitudinal and lateral directions; and deflector means extending in said third direction and disposed between said nozzles and said output ports, said deflector means being shiftable in said lateral direction to contact and deflect said fluid beams associated with said first and second nozzles.

* * * * *